United States Patent [19]

Leighton

[11] 4,243,291

[45] Jan. 6, 1981

[54] POLARIZED ELECTRICAL OUTLET

[75] Inventor: Robert D. Leighton, Brockton, Mass.

[73] Assignee: Alden Research Foundation, Brockton, Mass.

[21] Appl. No.: 957,461

[22] Filed: Nov. 3, 1978

[51] Int. Cl.[3] ..... H01R 13/64; H01R 13/50

[52] U.S. Cl. ..... 339/184 M; 339/191 M; 339/206 P

[58] Field of Search ..... 339/184 R, 184, 217 S, 339/176 MP, 210 R, 217 TP, 206, 125 R, 210 M, 210 T, 207, 191, 275 R

[56] References Cited

U.S. PATENT DOCUMENTS

| | | | |
|---|---|---|---|
| 1,615,302 | 1/1927 | Hartmann | 339/184 R X |
| 2,691,147 | 10/1954 | Sutton | 339/217 S |
| 2,833,998 | 5/1958 | Alden | 339/275 R X |
| 3,165,369 | 1/1965 | Maston | 339/210 M X |
| 3,185,953 | 5/1965 | Prifogle | 339/184 M X |
| 3,221,288 | 11/1965 | Eads | 339/184 M X |

*Primary Examiner*—John McQuade
*Assistant Examiner*—Joan S. Brown
*Attorney, Agent, or Firm*—James H. Grover

[57] ABSTRACT

A polarized electrical outlet of minimum size adapted to be fitted into a panel including a cap and a base, welded together and formed of thermoplastic material.

8 Claims, 7 Drawing Figures

POLARIZED ELECTRICAL OUTLET

BACKGROUND OF THE INVENTION

This invention relates to female electrical outlets and especially to outlets adapted to receive polarized blades of a plug. The outlet is designed to be located in an aperture in a panel and consume minimum space therein.

DESCRIPTION OF THE INVENTION

Electrical outlets for receiving polarized blades of a male plug are well known to the art. Such outlets have conventionally been formed of a fairly rigid thermo setting material such as phenolic resins, and when they are made very small, they can be chipped and broken, especially at the edges where contact is made with the prongs of the plug. Breakage not only requires replacement of the outlet but can also cause a short circuit and danger to human life.

An example of a type of outlet in the prior art is disclosed in the U.S. patent to Alden U.S. Pat. No. 2,833,998. This outlet is formed of two parts which are held together by a metal clamping member. The device provides an electrical outlet of minimum size compatible with the spacing of the contacts and is easily mounted in the panel. Assembly, however, requires holding two parts and clamping them together with a restrainer. Also, the outlet is formed of bakelite which requires a fairly thick spacing between the edges of the female apertures and the wall of the connector to provide for the required ruggedness.

SUMMARY OF THE INVENTION

According to the present invention, I have discovered that electrical outlets of minimal size can be molded to receive polarized blades of male plugs if thermoplastic materials are used for their construction. I have also discovered that when using thermoplastic materials, the pieces which form the connector can be welded together ultrasonically to form a tight intermolecular bond that is extremely rugged and durable, without having to add external hardware and clamps. The pieces which form the connector include a body and a cap. The cap includes a plate having first and second planar surfaces, each of which is disposed on opposite sides thereof. The first planar surface is adapted to butt against the rear of the panel in which the connector will be disposed. A crown having a generally rectangular rim is integrally molded with the cap and is disposed on the first planar surface. Two apertures are disposed in the crown and pass through the plate, one of the apertures being wider than the second so as to receive the wider of the polarized blades of the plug. A web is disposed between the exterior edges of the apertures and the rim of the crown, the width of the web between the ends of the wider of the two apertures and the rim of the crown being substantially the same as the width of the web between the side of that aperture and the rim of the crown. The spacing between the two apertures is pre-set by electrical code specifications, but by making the thickness of the web between the edges of the ends of the aperture and the rim of the crown substantially the same as the thickness of the web between the sides of the aperture and the rim of the crown, a crown of minimum size is provided.

The body of the connector has a central cavity and a mouth disposed thereon. Two arcuate contacts are movably disposed therein and have their convex surfaces respectively in abutment with the opposed edges of the cavity and arranged directly beneath the apertures. One end of the body has a slotted recess for slidably engaging the ends of the contacts and the other ends of the contacts rest in the opposite end of the body, thereby allowing the contacts to be free to expand lengthwise in the slotted recesses as the blades of the mating plug are inserted between the convex surfaces of the contacts and the opposing sides of the cavity. A flange having a third planar surface is integrally molded and disposed on opposite sides of the mouth of the body of the connector and is arranged to butt against the second planar surface in a parallel, face to face relation.

Sealing means are disposed on either the second or the third planar surfaces to enable these surfaces to be bonded together through ultrasonic welding and to form the outlet. In a preferred embodiment, a lip extends from the plate and encircling the second planar surface so as to form a container which is adapted to receive the flange associated with the mouth the body and enhance the rigidity of construction. Most desirably, the sealing means is an internal ridge that is disposed within the container at the juncture between the lip and the second planar surface to provide a starting point for the ultrasonic welding of the body and the cap. My preferred construction also includes a second web which is disposed on the bottom of the cavity and extends between the concave surfaces of the arcuate contact to meet with a boss which is disposed on the second planar surface centrally between the apertures. The second web and boss cooperate together to provide for excellent insulation between the apertures. The second web and boss cooperate together to provide for excellent insulation between the contacts and preclude the possibility of short circuits.

DRAWINGS

DESCRIPTION OF THE PREFERRED EMBODIMENTS

Figure 1:
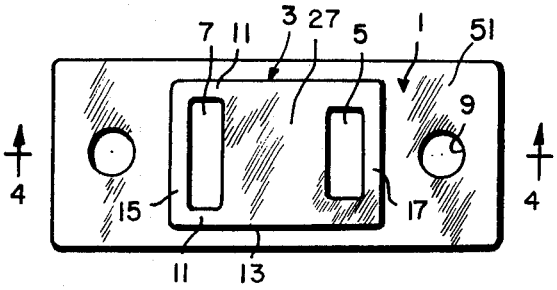
FIG. 1 is a top view of the molded thermoplastic electrical outlet for receiving polarized blades according to the present invention.

Turning now to FIG. 1, the top surface of the molded thermoplastic outlet according to the present invention is shown. The outlet includes plate 1 with a crown 3 disposed thereon. A pair of rectangular apertures 5 and 7 are formed in crown 3 and are adapted to receive blades (not shown) from a polarized male plug. The apertures are separated by web 27 and extend through the plate 1 so as to provide an entry from the blades into the body of the outlet described later. Since the outlet is adapted to be used with polarized plugs, one of the apertures 7 is longer than the other aperture 5 so as to receive the wider of the two blades. The crown 3 is of minimal dimensions so as to be fitted into an aperture in a panel, also of minimal size.

In use, the first planar surface 51 will butt against the rear of the panel and be secured by mechanical fasteners (not shown) which are fitted through the holes 9. To provide for the minimal size requirements, the webs 11 between the ends of the aperture 7 and the rim 13 of the crown 3 are of substantially the same thickness as that of the web 15 formed between the side of the aperture 7 and the rim of the crown 3. The width of the web 11 sets the minimum thicknesses of the webs around the rim and is preferably between about 0.05 to 0.07 inches which is sufficient to insulate the wide blade from the mounting panel (not shown). Web 17 between the side of the shorter of the two apertures and the rim 13 of the crown can be the same thickness as web 15 and web 11 to provide the requisite strength. The spacing between the apertures 5 and 7 is preset by electrical code requirements and is adequate to provide insulation between the blades of the male plug which will be inserted into it.

Figure 2:
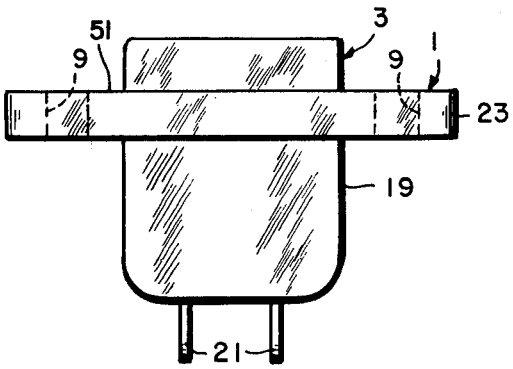
FIG. 2 is a side elevational view of an embodiment of the invention shown in FIG. 1.

Turning now to FIG. 2 it can be seen that the crown 3 is disposed on the top of the first planar surface 51. The body 19 of the outlet is disposed beneath the plate 1 and holds the contacts of the outlet. Tabs 21 extend from these contacts as will be seen in later figures and are adapted to be soldered to lead-in wires (not shown).

Figure 3:
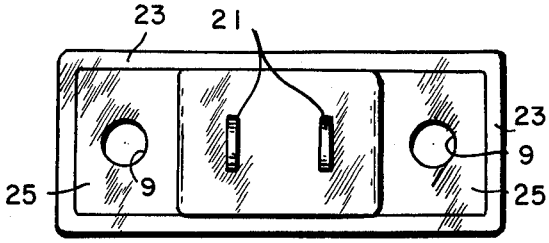
FIG. 3 is a bottom view of the connector shown in FIG. 2.

In FIG. 3 the bottom of the outlet is shown. Holes 9 are adapted to receive the mechanical fasteners and are arranged through the plate 1 (not shown) and flange 25. Tabs 21 extend through apertures in the body of the connector. A lip 23 extends from periphery of the plate 1 (not shown), surrounding flange 25 (see FIGS. 4 and 6) and forming a container. The depth of the container approximates the thickness of the flange 25 to provide a compact outlet.

Figure 4:
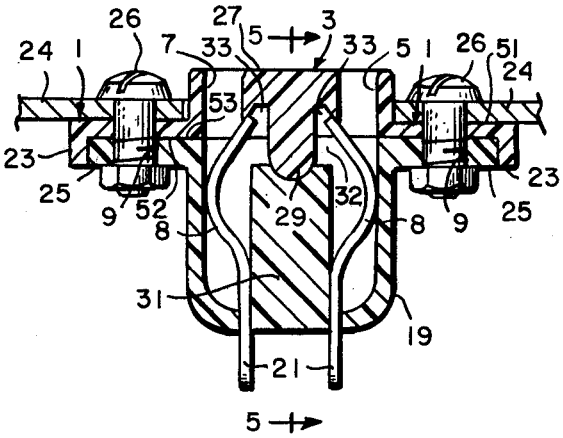
FIG. 4 is a cross sectional view taken along the lines 4—4 of FIG. 1 and particularly showing the disposition of the arcuate electrical contacts and also illustrating the insulation between them. A panel has been added to the view to show the mounting.

A sectional view taken along the lines 4—4 of FIG. 1 is shown in FIG. 4 to illustrate the dimensions of the various webs and the positioning of the electrical contacts. The outlet is held to a panel 24 by mechanical fasteners such as nuts and bolts 26 which are fitted in holes 9. As shown, the first planar surface 51 butts against the rear of the panel 24 and crown 3 extends through the hole in the panel which has been appropriately dimensioned to receive it. Apertures 5 and 7 are separated from each other by web 27 which is disposed therebetween. A boss 29 extends downwardly from web 27 and butts against inner web 31 which extends upwardly from the bottom of the body 19. Preferably, boss 29 has a cylindrical end portion which seats in a mating cylindrical end portion disposed at the interior end of web 31 to aid in assembly. A pair of electrical contact strips 8 are housed in body 19 and are formed of electrical conducting material such as copper or bronze and are bent into an arcuate configuration. The width of the cavity in the body 19 of the outlet is only slightly greater than the width of the contact strips 8 to provide a small clearance when the strip is inserted therein. The lower end of the contact strip is disposed upon the bottom wall of the body of the outlet and the tabs 21 extend through apertures disposed in the body of the outlet. The two contacts 8 are maintained in a spaced relationship in the body 19 with their concave faces opposing each other and separated by a central web 31. The upper ends of the contacts are fitted into two recesses 33 which are disposed within the central web 27 and serve to provide positive retainment. When the blades of the male plug are inserted through the apertures 5 and 7 the tips will force the contact strips 21 away from the walls of the body 19 and drive the ends of the strips into recesses 33.

The body 19 of the connector terminates with a mouth 32 that has the flange 25 extending from opposite sides thereof and arranged to fit against the second planar surface 52. The lip 23 extends around the periphery of the plate flange 1 and forms the container which holds the flange 25 associated with the body 19. While for purposes of illustration, the cap is shown as a distinct entity from the body 19 in the assembled unit, it should be understood that they are molecularly bonded to each other. Such bonding is accomplished by ultrasonically welding the two surfaces together as will be described later.

Figure 5:
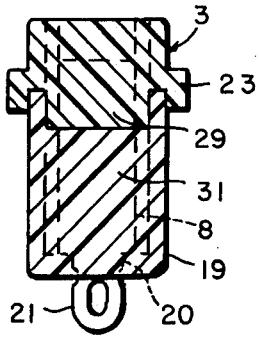
FIG. 5 is a cross sectional view of the electrical connector shown in FIG. 4.

Turning now to FIG. 5 it can be seen that the arcuate contact 8 is of a generally rectangular shape and rests against the bottom of the body 19 of the outlet. Extending from the body portion 19 is the tab 21 which passes through an aperture 20 in the bottom thereof. The tab 21 serves to locate the arcuate contact 8 centrally within the outlet and to eliminate lateral movement together with providing a means for an electrical connection. The upper portion of the electrical contact 8 is held within the cap by the recesses described previously.

Figure 6:
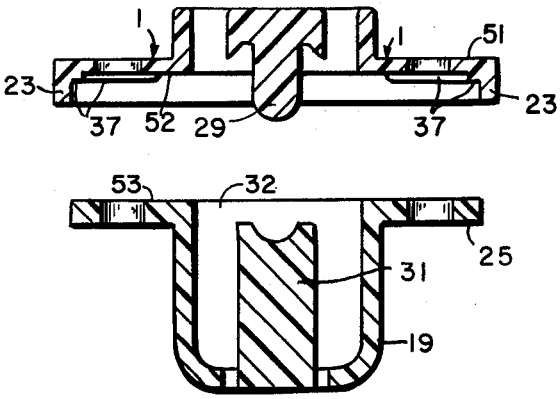
FIG. 6 is an exploded cross sectional view of the electrical connector of the present invention with the arcuate contacts removed.

Turning now to FIG. 6, an exploded view of the outlet is shown with the arcuate contacts removed. The structure is the same as that which is shown in FIG. 4 except in this view a sealing means 37 is disposed on the second planar surface 52 inside of the container formed by lip 23 and plate 1. The sealing means 37 preferably is a raised ridge which extends around the perimeter of the container and preferably, this ridge is between about 0.03 to 0.1 inches high and 0.01 to 0.02 inches wide. When the second planar surface 52 inside of the container is placed against the third planar surface 53 extending from the sides of the mouth of the body 19 and they are mutually vibrated under ultrasonic conditions, a seal will be formed. The seal starts from the ridge and the heat in the neighborhood of 200° C. to 280° C. is generated by friction from the ultrasonic vibration to cause the thermoplastic materials to fuse and molecularly bond to each other. The ridge 37 provides a starting point for the heat fusion process and eventually, the seal will spread from this starting point throughout the surfaces which are being mutually vibrated. Although I have found that a ridge inside of the container is preferable for forming the bond, other sealing means such as dimples disposed upon either of the opposing planar surfaces can also provide the necessary fusing. When sealed, the parts are permanently bonded to each other and boss 29 will be seated within the cavity formed at the top of inner web 31 and the electrical contacts will be seated within the outlet as shown in FIG. 4.

Figure 7:
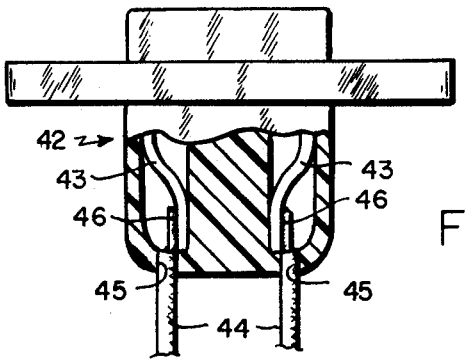
FIG. 7 is a side elevational view, partially in cross section, showing an embodiment of the invention in which lead-in wires extend through the body of the connector to the arcuate contacts.

The embodiment of the invention shown in FIG. 7 involves running lead-in wires 44 through apertures 45 in the base 42. The lead-in wires 44 are soldered to arcuate contacts 43 at 46. In the embodiment of FIG. 4, tabs 21 are extended through holes in the base and wires are attached externally. The bottom of arcuate contacts 43 in the embodiment of FIG. 7, rest in the cavity of base 42 and function as was described with reference to the embodiment of FIG. 4.

Many thermoplastic materials can be used to form the electrical outlet disclosed herein. For example, polyesters, acrylics, aceytyls, polystyrene and polyvinyl chloride in the rigid form are quite suirable for molding and ultrasonic welding according to the present invention. Quite advantageously, these thermoplastic materials are quite easily color coded which is frequently necessary in electrical work. Rigid thermo-setting materials frequently are black in color and do not lend themselves to modifications in color. Moreover, the thermoplastic materials from which I form the present outlet can easily be hot stamped and embossed with a suitable indicia. Thermosetting materials on the other hand, do not melt when the heat stamping equipment is applied to their surfaces and hence cannot readily be not stamped.

It is apparent that modifications and changes can be made within the spirit and scope of the present invention. It is my intention, however, only to be limited by the scope of the appended claims.

I claim:

1. A polarized electrical outlet for receiving a male plug with polarized blades of dissimilar widths comprising:

a body and a cap, said body and said cap each being formed of a thermoplastic material;

said cap including a plate with first and second planar surfaces disposed on opposite sides thereof, said first planar surface adapted to butt against the rear of a panel;

a crown having a generally rectangular rim integrally molded and disposed on the first planar surface;

a first cap-aperture and a second cap-aperture disposed in said crown and passing through said plate, said first cap-aperture being wider than said second cap-aperture so as to receive the wider of said polarized blades;

a web disposed between the exterior edges of said first cap-aperture and the rim of the crown, the width of the web between the ends of the first cap-aperture and the rim of the crown being substantially the same as the width of the web between the side of the first cap-aperture and the rim of the crown;

said body having a central cavity therein and a mouth disposed at one end thereof and a pair of body-apertures disposed at the other end thereof;

two arcuate contacts movably disposed within said cavity with their convex surfaces respectively in abutment with the opposed sides of said cavity and arranged directly beneath said cap-apertures, said contacts being narrowed at one end thereof to form shoulders with tabs extending therefrom, said shoulders being arranged to rest on the cavity and said tabs extending through said body-apertures;

slotted recesses disposed in said cap for slidably engaging first ends of said contacts and the other ends of said contacts resting against the interior of said body, said contacts being free to expand lengthwise into said slotted recesses as the blades of a mating plug are inserted between the convex surfaces of the contacts and the opposed sides of the cavity;

a third planar surface integrally molded and disposed on opposite sides of said mouth and arranged to butt said second planar surface in a parallel face-to-face association; and sealing means disposed on said second and/or third planar surface for bonding said second and third planar surfaces together and form the connector.

2. The polarized electrical connector according to claim 1 wherein a lip extends from said second planar surface around the perimeter thereof so as to form a container, said container being adapted to receive the mouth and the third planar surface of said body.

3. The polarized electrical connector according to claim 2 wherein said sealing means is an internal ridge disposed within said container at the juncture between said lip and said second planar surface.

4. The electrical connector according to claim 1 wherein a second web is disposed on the bottom of said cavity and extends between the concave surfaces of said arcuate contacts to insulate said contacts from each other and further wherein a boss is disposed on said second planar surface centrally between said body-apertures and arranged to engage the web which extends from the bottom of said cavity.

5. A polarized electrical outlet for receiving a male plug with polarized blades of dissimilar widths comprising:

a body and a cap, said body and said cap each being formed of a thermoplastic material;

said cap including a plate with first and second planar surfaces disposed on opposite sides thereof, said first planar surface adapted to butt against the rear of a panel;

a crown having a generally rectangular rim integrally molded and disposed on the first planar surface;

a first cap-aperture and a second cap-aperture disposed in said crown and passing through said plate, said first cap-aperture being wider than said second cap-aperture so as to receive the wider of said polarized blades;

a web disposed between the exterior edges of said first cap-aperture and the rim of the crown, the width of the web between the ends of the first cap-aperture and the rim of the crown being substantially the same as the width of the web between the side of the first cap-aperture and the rim of the crown;

said body having a central cavity therein and a mouth disposed at one end thereof and a pair of body-apertures disposed at the other end thereof;

two arcuate contacts movably disposed within said cavity with their convex surfaces respectively in abutment with the opposed sides of said cavity and arranged directly beneath said cap-apertures;

slotted recesses disposed in said cap for slidably engaging first ends of said contacts and the other ends of said contacts resting against the interior of said body, said contacts being free to expand lengthwise into slotted recesses as the blades of a mating plug are inserted between the convex surfaces of the contacts and the opposed sides of the cavity, said other ends of said contacts being disposed adjacent said pair of body apertures and arranged to receive lead-in wires threaded therethrough;

a third planar surface integrally molded and disposed on opposite sides of said mouth and arranged to butt said second planar surface in a parallel face-to-face association; and sealing means disposed on said second and/or third planar surface for bonding said second and third planar surfaces together and form the connector.

6. The polarized electrical connector according to claim 5 wherein a lip is molded to and extends from said second planar surface around the perimeter thereof so as to form a container, said container being adapted to receive the mouth and the third planar surface of said body.

7. The polarized electrical connector according to claim 6 wherein said sealing means is an internal ridge disposed within said container at the juncture between said lip and said second planar surface.

8. The electrical connector according to claim 5 wherein a second web is disposed on the bottom of said cavity and extends between the concave surfaces of said arcuate contacts to insulate said contacts from each other and further wherein a boss is disposed on said second planar surface centrally between said body-apertures and arranged to engage the web which extends from the bottom of said cavity.

* * * * *